United States Patent [19]

Rubens et al.

[11] Patent Number: 4,713,927

[45] Date of Patent: Dec. 22, 1987

[54] PROCESS AND APPARATUS FOR PACKAGING

[75] Inventors: Louis C. Rubens; Willard E. Alexander, both of Midland, Mich.

[73] Assignee: The Dow Chemical Company, Midland, Mich.

[21] Appl. No.: 863,625

[22] Filed: May 15, 1986

[51] Int. Cl.[4] ..... B29D 27/04

[52] U.S. Cl. ..... 53/472; 53/527; 493/904

[58] Field of Search ..... 53/472, 527, 523; 493/904; 53/513

[56] References Cited

U.S. PATENT DOCUMENTS

| | | | |
|---|---|---|---|
| 3,412,521 | 11/1968 | Bauman | 53/472 X |
| 3,446,882 | 5/1969 | Landon | 53/472 X |
| 3,450,253 | 6/1969 | Nielsen | 53/472 X |
| 4,030,267 | 6/1977 | Arnaud | 53/472 X |
| 4,136,141 | 1/1979 | Bauer et al. | 53/472 X |

*Primary Examiner*—James F. Coan

[57] ABSTRACT

Pneumatic synthetic resinous foams are used as dunnage. Foams are added to a package under fluid pressure; the package closed, the pressure reduced to atmospheric, and particulate pneumatic foam expands to fill container.

10 Claims, 5 Drawing Figures

PROCESS AND APPARATUS FOR PACKAGING

A wide variety of materials have been employed as dunnage for the shipping of various articles. For relatively fragile articles, light weight dunnage has often been employed such as crumpled paper, shredded paper, excelsior and a variety of foam synthetic resinous particles. Such foam particles are well known and are disclosed in the following U.S. patents which are herewith incorporated by reference thereto: U.S. Pat. Nos. 3,066,382; 3,147,321; 3,251,728; 3,400,037; 3,723,240; 3,887,672; 3,896,934; 3,961,000; 4,027,064; 4,042,658; 4,166,875; 4,169,179; and 4,485,193. Some similar synthetic resinous particles of low density are prepared by overexpanding the particles to an extent sufficient that on cooling to ambient temperature they are partially collapsed and on standing in air will re-expand. The preparation of such particles is set forth in the following U.S. patents which are incorporated by reference thereto: U.S. Pat. Nos. 3,425,965; 3,505,248; 3,505,249; and 3,507,177.

Expanded thermoplastic synthetic resinous particles of low density, that is in the range of 0.25 to 2 pounds per cubic foot, may be difficult to handle and control using conventional methods. Equipment to handle such particles has been developed and has been described in the following U.S. patents the teachings of which are herewith incorporated by reference thereto: U.S. Pat. Nos. 3,708,208 and 4,284,372. Generally the synthetic resinous particles used for dunnage are shaped in such a way that under pressure they tend to interlock and retain their positions relative to one another. Spherical foamed particles are considered generally to be of low value in the dunnage area because of the ease with which an article will settle or change position when subjected to vibration.

It would be desirable if there were available an improved packaging process which would utilize spherical cellular particles.

It would be desirable if there were available an improved dunnage process utilizing low density expanded particles wherein the particulate material is of relatively low cost.

It would also be desirable if there were available an improved apparatus for providing that dunnage to containers.

These benefits and other advantages in accordance with the present invention are achieved in a process of packaging an article within a container the steps of the method comprising providing a container having sufficient dunnage therein to position the article in a generally desired location within the container, injecting into the container under superatmospheric pressure a quantity of partially collapsed foamed synthetic resinous particles, reducing the pressure within the container to atmospheric pressure and thereby causing partially collapsed particles to expand and contact adjacent particles, the article and container walls and thereby form a plurality of deformed particles maintaining the article in a desired relationship to the container walls.

Also contemplated within the scope of the present invention is an apparatus for the filling of containers with pneumatic synthetic resinous dunnage materials, the apparatus comprising in cooperative combination a container restraining means, a particle supply means, a particle supply means positioning means, the positioning means adapted to position the supply means in a direction generally normal to a surface of the container, the supply means having means to force particles into the container and to supply a superatmospheric pressure within the container.

Also contemplated within the scope of the invention is a package, the package having flexible fluid permeable walls and containing a plurality of pneumatic synthetic resinous particles.

Further features and advantages of the present invention will become more apparent from the following specification taken in connection with the drawing wherein.

Figure 2:
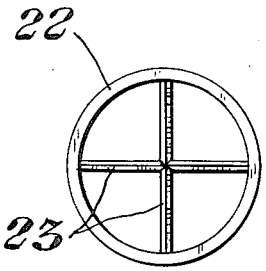
FIG. 2 is a bottom end view of the particle dispensing apparatus of FIG. 1.
Figure 1:
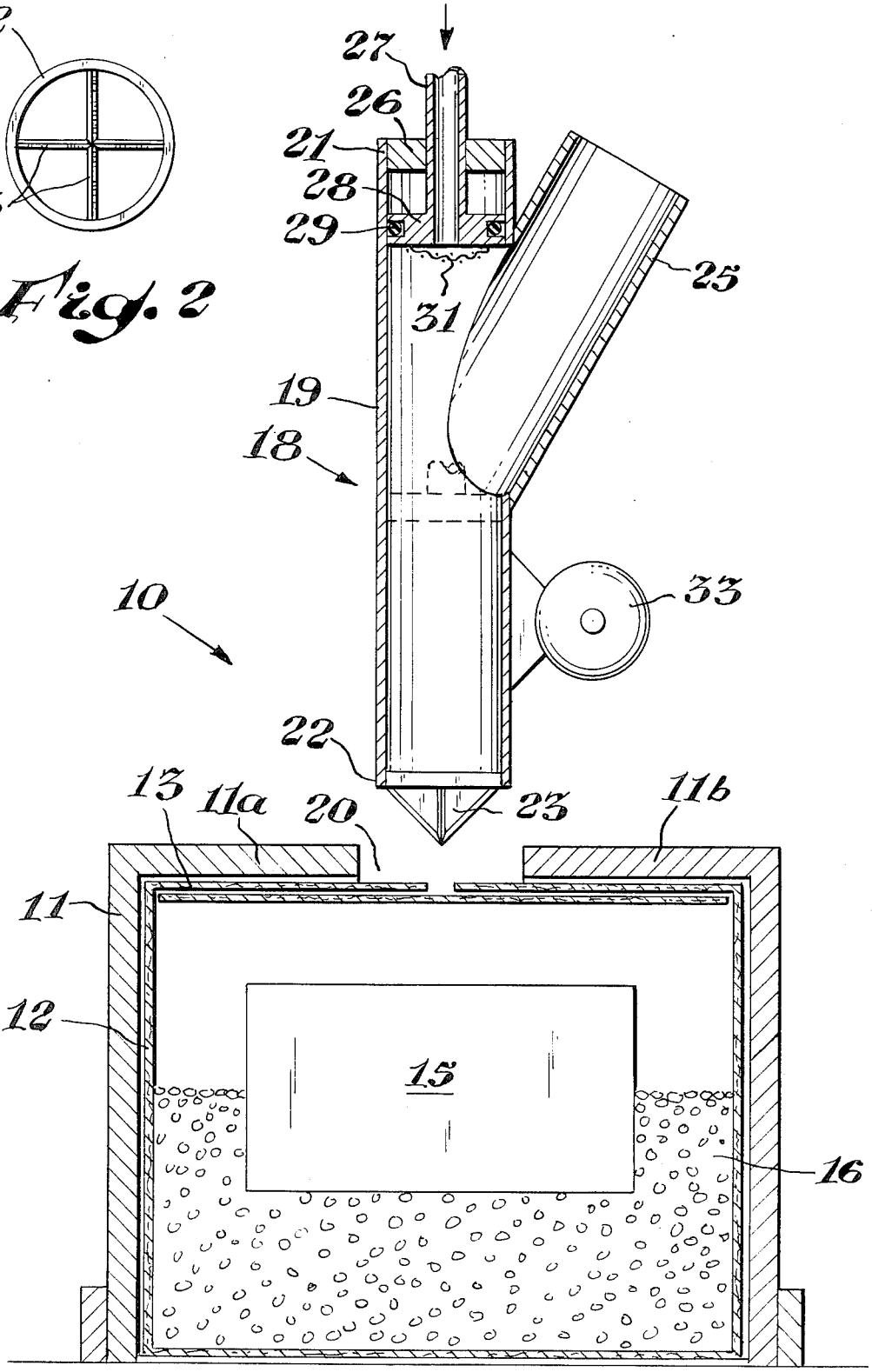
FIG. 1 is a schematic partially in section view of an apparatus in accordance with the present invention.

In FIG. 1, there is depicted a container filling apparatus in accordance with the present invention generally designated by the reference numeral 10. The apparatus 10 comprises a container restraining means 11. The container restraining means 11 comprises a first open box like member 11*a* and a second similar member 11*b*. The members 11*a* and 11*b* can be moved toward or away from each other by means not shown, such as pneumatic cylinder or cylinders. The box like members 11*a* and 11*b* as depicted in FIG. 1 are in the closed position, that is, they are positioned close to each other as opposed to remote. Disposed within the restraining means 11 is a container 12. The container 12 for purposes of illustration can be considered as a corrugated board container. The container 12 has a top 13 comprising 4 flaps hingedly affixed one to each side of the rectangular container in the manner of conventional rectangular corrugated paper boxes. Disposed within the container is an article 15 and is supported in a generally desired position by a plurality of dunnage particles 16. A particle dispensing means 18 is disposed generally adjacent the top 13 of the container 12 and a centrally located position at the top of the container 12 adjacent an opening 20 defined by the restraining means 11. The particle supply means or stuffer comprises a generally cylindrical body 19. The cylindrical body 19 having an upper or remote end 21 and a lower or adjacent end 22. The end 22 has supported therein a container perforating means designated by the reference numeral 23. The perforating means 23 has the general configuration of a 4-bladed broadhead arrow. Note FIG. 1. However, it tapers to a point external to the body 19 and the point has an angle much greater than that of a conventional broadhead arrow. A particle supply means or feed tube 25 is disposed on the cylindrical body 19 and provides communication with the body 19. The body 19 and the particle supply means or feed tube 25 form a Y with one leg offset. The feed tube 25 is generally adjacent the upper end 21. Disposed within the upper end 21 of the body 19 is a bushing 26 having disposed therein a hollow piston rod 27. The hollow piston rod 27 is in selective communication with a source of pressurized fluid such as compressed air, not shown. The piston rod 27 within the cylindrical body 19 terminates in a piston 28. The piston 28 has a circumferential O-ring 29 in sealing engagement with the interior of the body 19, remote from the piston rod 27. The piston has affixed thereto a perforate layer or screen 31. Affixed to the body 19 adjacent lower end 22 is a vibrator 33.

In operation of the apparatus of FIG. 1, the container restrainer members 11*a* and 11*b* are opened. The container such as the container 12 is partially filled with the dunnage; the article to be packaged positioned on the dunnage and the container closed such as by folding downward 4 flaps. The container is positioned between the container restrainer portions 11*a* and 11*b* the restrainer portions are then positioned about the container as depicted in FIG. 1. The body 19 is moved toward the container until the perforating means 23 has perforated the container and end 22 engages the container top 13. Pneumatic synthetic resinous particles flow from source 25 into body 19. The piston 28 is moved downwardly to force particles into the container 12. The operation is repeated a sufficient number of times to provide a desired quantity to fill or almost fill the container. Additional particles are then added with superatmospheric pressure applied through hollow piston rod 27 to thereby cause the volume of the pneumatic particles to decrease. The quantity of particles of decreased volume added are dependent upon the desired density of the dunnage in the final package. The supply means 18 is then retracted from the container. The perforated and deflected portion of the top 13 is forced back into its original position by expanding particles and sealed beneficially by means of an adhesive tape.

Figure 3:
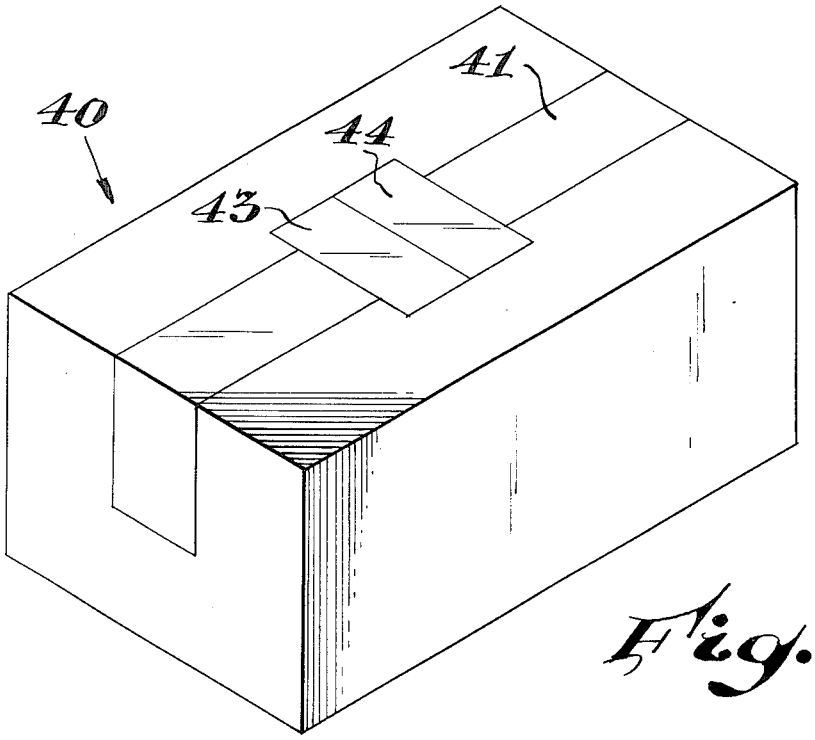
FIG. 3 is a representation of a container filled in accordance with the present invention.

In FIG. 3, there is depicted a carton 40 having dunnage positioned therein by means of the present invention. The carton 40 is sealed by means of a first generally longitudinal adhesive tape 41. The region of perforation by the perforating means 23 has been sealed by two pieces of tape designated by the reference numerals 43 and 44 generally transverse the longitudinal tape 41.

Figure 4:
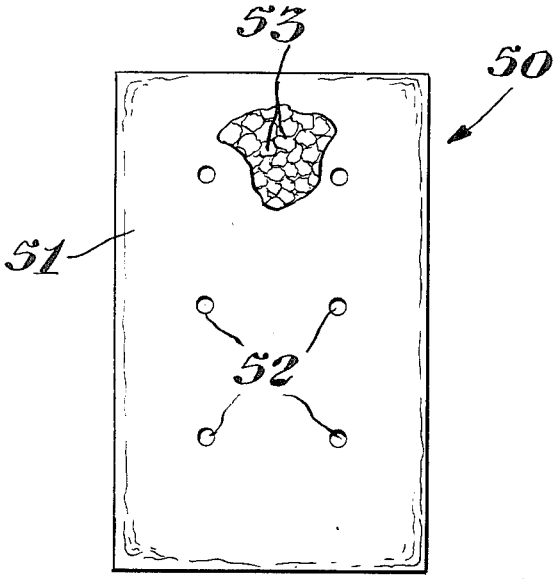
FIG. 4 depicts a view of a flexible container in accordance with the invention.

In FIG. 4, there is depicted an alternate form of dunnage useful in the practice of the present invention designated by the reference numeral 50. The dunnage 50 comprises a closed flexible container 51 such as perforate plastic bag having perforations 52 therein. The flexible container 51 has disposed therein a plurality of pneumatic foam particles 53 and as depicted in FIG. 4 the particles are spherical.

Figure 5:
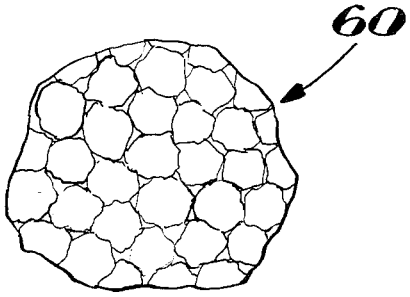
FIG. 5 schematically depicts a relationship of pneumatic particles in accordance with the invention in a container at atmospheric pressure.

FIG. 5 is a schematic representation of a plurality of pneumatic particles 60 wherein the expansion of the particles has caused the spherical particles to distort into a plurality of polygons and substantially reduce void space. One could call such a structure as a molding of the particles without bonding of the particles.

By the term "pneumatic cellular synthetic resinous particle" is meant a particle having a bulk density of less than about 2 pounds per cubic foot capable of being compressed in one dimension to 50 percent of its original dimension, and on release of the compressive force returning to at least 90 percent of its original dimension in a period of time less than 15 seconds. Various pneumatic foam particles are well known. Styrene polymer pneumatic particles are disclosed in U.S. Pat. Nos. 3,607,797; 3,878,133 and 4,485,193, the teachings of which are incorporated by reference thereto. In the latter patent disclosures, the very low density pneumatic foams are formed from lightly crosslinked thermoplastics. Other pneumatic foams ethylene polymers are disclosed in U.S. Pat. Nos. 3,098,831; 3,098,832; 3,504,068; and 3,711,430, the teachings of which are herewith incorporated by reference thereto.

U.S. Pat. No. 3,227,664 discloses pneumatic closed cell foams prepared from polyethylene terephthalate and polypropylene. A wide variety of synthetic resinous thermoplastic materials may be utilized for the practice of the present invention. If the particles meet the hereinbefore described compression and re-expansion limitations, they can be used in the practice of the present invention. Generally, however, for most applications where a relatively light weight article is being packaged, lower densities are preferred. Packages in accordance with the process of the present invention may be prepared in a variety of ways. If one has a relatively large number of packages to be prepared, the use of an apparatus in accordance with FIG. 1 provides maximum convenience and minimum labor for those preparing the package.

When smaller quantities of materials are utilized, packages of pneumatic foam particles are very desirable. Such packages advantageously are prepared to have a generally pillow-like configuration, that is a rectangular plastic bag filled with particles, sealed to retain particles, but having sufficient perforations in the wall to permit relatively free passage of air or other gas therethrough. Such pillows can be conveniently placed in a container, the article placed on the pillows, the pillows placed over the article for assembly in sufficient quantity to overfill a container by about 20 percent, pressure applied to the container, the container closed and the pressure released causing the particles within the pillow to expand and provide a desirable nonshifting dunnage. It should be emphasized that fluid pressure is required to obtain desirable packaging. Mechanical pressure in an amount sufficient to give desired deformation for packaging generally results in destruction of a portion of the particle.

By way of further illustration, a quantity of pneumatic closed cell foam particles were prepared in accordance with Example 1 of U.S. Pat. No. 4,485,193. The original particles had a diameter of 1.53 millimeters, were expanded by heating to a diameter of about 10.1 millimeters. When rolled between the thumb and forefinger, the particles gave the impression of a small inflated rubber balloon. The density of the foamed particles was about 0.21 pound per cubic foot. The bulk density of the particles was about 1.6 pounds per cubic foot. The expansion of the particles resulted in an increase in volume of about 290 times. A cylindrical glass vessel having a diameter of 2½ inches and a length of 5½ inches was filled with foam particles. The vessel was closed on the bottom and the contents of the tube subjected to superatmospheric nitrogen at various pressures up to 14 pounds per square inch gauge resulting in 41 percent compression, that is 59 percent of the original volume. On release of the pressure, particles increased in diameter within 15 seconds and were free flowing. For comparison, a portion of the same particles were placed in a 2300 cubic centimeter stainless steel beaker and were subjected to a mechanical loose fitting plug and the particles compressed to about half the original volume. It was observed that many of the foam particles had been destroyed.

The invention is further illustrated but not limited by the following examples.

EXAMPLE I

A corrugated paper box which measured 8×8×5 inches when closed was modified by shortening two of the opposed flaps by ½ inch. The bottom of the box was modified by removal of a major portion of the bottom and substituting a transparent plastic sheet. The box was filled to a depth of about 1½ inches with the previously prepared foam particles and a 16 ounce glass bottle placed upon the particles. Additional foam particles were poured into the box until the level was about 6½ inches high, the flaps being in an upright position. Rubber bands were provided to tension opposed pairs of flaps to close, and the box and the flaps were maintained in an upright position by the use of an 8×8 aluminum plate having a centrally disposed push rod extending thru the top. The box with the aluminum particles and aluminum plate was positioned within a pressure cooker, the cooker closed and pressurized to 5.5 pounds per square inch gauge. The aluminum plate was removed and the rubber bands closed the flaps in the desired sequence. On observation through the transparent plastic bottom, the particles had been deformed to substantially decrease the void space therebetween and the bottle did not move within the package when the package was subjected to vibration.

EXAMPLE II

The general procedure of Example I was repreated with the exception that the dunnage material was contained within two 10×10 inch ×0.001 inch thick polyethylene bags having a plurality of holes about 3/16 inch diameter. In one bag 4.1 grams of foam particles were placed and in the other bag 4.6 grams of foam particles were used. One of the bags was placed in the bottom of the box and a 16 ounce glass bottle on top of the bag and the second bag placed over the bottle. Examination of the contents of the box through the transparent bottle showed the particles in a configuration similar to that of Example I. It is noted that the particles within the polyethylene bags are much easier to handle than unconfined particles.

EXAMPLE III

The procedure of Example II was repeated with the exception that the pneumatic foam particles were of low density polyethylene having a density of 1.6 pounds per cubic foot and the particles were cylindrical and measured 1 centimeter by 1 centimeter. The resulting bulk density of the packing material which completely immobilized the bottle was 1.14 pounds per cubic foot.

The practice of the present invention permits the use of low density relatively low cost foam particles, and particularly desirable is the use of spherical particles which in many cases is a form which can be obtained directly from the polymerization vessel and without the need of an extruder. The present invention provides desired protection without requiring foam particles being converted into a coherent or molded structure. If unconfined particles are utilized, such as in Example I, a relatively tamper proof package is provided as if one were opened, it would be very difficult to return it to its original condition without the aid of a pressure chamber.

The present invention permits wide and ready variation of the load bearing characteristics of the dunnage material without major equipment or operation variation.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A process of packaging an article within a paper board container the steps of the method comprising providing a paper board container having sufficient dunnage wherein to position the article in a generally desired location within the paper board container, closing the paper board container, slitting a portion of the top of the paper board container, injecting into the paper board container through the slit portion under superatmospheric pressure a sufficient quantity of partially collapsed foamed synthetic resinous particles, reducing the pressure within the paper board container to atmospheric pressure and thereby causing partially collapsed particles to expand and contact adjacent particles, the article and paper board container walls and thereby form a plurality of deformed particles maintaining the article in a desired relationship to the paper board container walls.

2. A process of packaging an article within a container the steps of the method comprising providing a container having sufficient dunnage wherein to position the article in a generally desired location within the container, injecting into the container under superatmospheric pressure a sufficient quantity of partially collapsed foamed synthetic resinous particles, reducing the pressure within the container to atmospheric pressure and thereby causing partially collapsed particles to expand and contact adjacent particles, the article and container walls and thereby form a plurality of deformed particles maintaining the article in a desired relationship to the container walls.

3. The process of claim 1, wherein the particles are generally cylindrical.

4. The process of claim 1, wherein the container is disposed within a restraining means during injection under superatmospheric pressure.

5. The process of claim 1, wherein the particles are of a styrene polymer.

6. The process of claim 1, wherein the particles are of an ethylene polymer.

7. The process of claim 1, wherein the particles are generally spherical.

8. The process of claim 1, wherein at least a portion of the particles are contained within fluid permeable flexible walls.

9. A package prepared by the method of claim 1.

10. An apparatus for the filling of containers with pneumatic synthetic resinous dunnage materials, the apparatus comprising in cooperative combination a container restraining means, a particle supply means, a particle supply means positioning means, the positioning means adapted to position the supply means in a direction generally normal to a surface of the container, the supply means having means to force particles into the container and to supply a superatmospheric pressure within the container.

* * * * *